US006609945B2

(12) United States Patent
Jimenez et al.

(10) Patent No.: US 6,609,945 B2
(45) Date of Patent: Aug. 26, 2003

(54) RADIO-CONTROLLED TOY BLIMP WITH INFRARED BEAM WEAPONS FOR STAGING A GUN BATTLE

(75) Inventors: Oscar Jimenez, Coral Gables, FL (US); Francisco Jose Barreras, Sr., Miami Beach, FL (US); Roberto Echarri, Miami, FL (US); Guillermo Echarri, Miami, FL (US)

(73) Assignee: Plexus, Inc., Miami, FL (US)

( * ) Notice: Subject to any disclaimer, the term of this patent is extended or adjusted under 35 U.S.C. 154(b) by 101 days.

(21) Appl. No.: 09/779,818

(22) Filed: Feb. 8, 2001

(65) Prior Publication Data

US 2002/0106966 A1 Aug. 8, 2002

(51) Int. Cl.[7] ..... A63H 30/00

(52) U.S. Cl. ..... 446/454; 446/456; 446/225; 446/220; 244/30; 244/96

(58) Field of Search ..... 446/30, 59, 68, 446/220, 230, 225, 222, 36, 57, 58, 454, 455, 456, 470, 901; 244/24–33; 434/11, 14, 15, 12

(56) References Cited

U.S. PATENT DOCUMENTS 3,665,643 A * 5/1972 Colgrove ..... 446/457
4,247,107 A * 1/1981 Smith et al. ..... 104/296
4,443,014 A * 4/1984 Kovit et al. ..... 244/190
4,799,914 A * 1/1989 Hutchinson ..... 244/30
4,891,029 A 1/1990 Hutchinson
4,931,028 A 6/1990 Jaeger et al.
4,938,483 A * 7/1990 Yavetz ..... 273/454
4,964,837 A * 10/1990 Collier ..... 369/30.02
4,981,456 A * 1/1991 Sato et al. ..... 244/17.13
5,127,658 A * 7/1992 Openiano ..... 446/130
5,195,920 A * 3/1993 Collier ..... 446/175
5,882,240 A 3/1999 Larsen
5,906,335 A * 5/1999 Thompson ..... 244/24

* cited by examiner

*Primary Examiner*—S. Thomas Hughes
*Assistant Examiner*—Alex F. R. P. Rada, II
(74) *Attorney, Agent, or Firm*—Thomas R. Vigil; Welsh & Katz, Ltd.

(57) ABSTRACT

The remote-controlled air, land or water borne toy vehicle comprises: a body; a printed circuit board mounted in or to the body; a receiver connected to the printed circuit board for receiving commands; hardware on the printed circuit board including control circuitry for manipulating the toy vehicle in response to commands received by the receiver; and a motor drive mechanism mounted on or to the toy vehicle for moving or propelling the toy vehicle in response to control signals from the control circuitry. Preferably at least one of several infrared emitting simulated weapons are mounted on the toy vehicle and are selected from the group including a machine gun, a cannon and a missile.

32 Claims, 7 Drawing Sheets

RADIO-CONTROLLED TOY BLIMP WITH INFRARED BEAM WEAPONS FOR STAGING A GUN BATTLE

BACKGROUND OF THE INVENTION

1. Field of the Invention

The present invention relates to a radio controlled toy blimp and to a method for constructing a remote-controlled toy blimp for amusement purposes having circuitry capable of firing and detecting infrared light beams bearing specific codes. Two or more such toy blimps can then be used to stage a simulated battle for entertainment purposes. Several weapons are available to each toy pilot. A "light artillery" simulates a machine gun which inflicts minor damage to a toy blimp, requiring a high number of hits to disable the opponent's toy. A "heavy artillery" simulates a large caliber cannon which inflicts heavier damage than light artillery, requiring less hits to disable the opponent's toy blimp. An "explosive missile" is the most damaging weapon requiring only a single hit to disable the opponent's toy. A red lamp in the opponent's toy will flash when a successful "hit" is made.

When the required number of hits to disable the opponent's toy is reached, the opponent's toy will automatically engage in an "out of control" maneuver, such as erratic motion to simulate a disabled vehicle. Also, the red lamp will flash continuously for a pre-set time to indicate that the toy has been mortally wounded. In another aspect of this invention, an infrared wall target is provided for shooting practice.

Each toy's gun can be set to transmit a different ID code so that the strikes of each player can be identified.

An additional aspect of the present invention relating to a toy blimp, employs a single printed wired board to serve, in an unconventional manner, as the structural beams supporting all three flight motors while at the same time providing the conventional interconnections between all the electrical circuitry, significantly reducing the time and cost required to assemble a blimp.

Also, relating to a toy blimp, a further aspect of the present invention provides for a "docking station" used for rearming and refueling the blimp. This docking station can be rendered out of order by the opponent's infrared weapons. Therefore, each pilot in addition to defending his/her blimp, must also defend his/her docking station to ensure rearming and refueling capabilities.

A final aspect of the present invention provides for a mechanism for reducing the angle of the transmitted infrared beam in order to increase the level of difficulty required for hitting the target.

2. Description of the Prior Art

A number of new, state-of-the-art toy blimps have been developed for amusement purposes. These lighter-than-air blimps are filled with lighter-than-air gases, such as helium. Typically, a gondola is attached to the bottom, with reversible motor driven propellers whose thrust can be directed down for climbing or up for descending. By engaging one motor forward and the other in reverse, the blimp can rotate 360° or turn left or right.

A search of the prior art brought to light the following US patents which disclose devices in the same general field of the present invention but without the unique and novel advantages of the present invention:

U.S. Pat. No. 4,931,028: TOY BLIMP. This document discloses a toy blimp having at least one engine, and preferably two, mounted on the top side of an inflatable helium balloon-blimp like member, and an infrared control circuit and power supply mounted on the bottom side. A remote control transmitter with push buttons transmits an infrared control signal to a receiver in the balloon for horizontal and vertical flight control exclusively. This prior art device doesn't offer any capability for remotely controlled infrared weapons.

U.S. Pat. No. 5,882,240: TOY BLIMP. This document discloses a toy blimp, including a gas filled body, a plurality of fins, a wind-up propulsion system consisting of a rubber band or a spring loaded motor, and small weight clips for buoyancy control. This prior art device doesn't offer any capability for remotely controlled infrared weapons.

U.S. Pat. No. 4,891,029: REMOTE CONTROL LIGHTER-THAN-AIR TOY. This document describes a remotely controlled lighter-than-air toy having an inflatable container shaped as dirigible for holding lighter-than-air gas. A removable gondola is attached to the underside of the dirigible. This gondola has a first electric motor coupled, by means of gears, to a shaft passing through the gondola. A second and third reversible motors are mounted on each end of this shaft, on either side of the gondola. These second and third reversible motors drive propellers used provide forward and reverse thrust, thus providing horizontal flight control. The first reversible motor is used adjust the position of the shaft relative to the horizontal plane, thus providing vertical flight control. All three motors are remotely controlled by a conventional radio transmitter known to the art. This prior art device does not offer any capability for remotely controlled infrared weapons.

SUMMARY OF THE INVENTION

The present invention relates to a remote-controlled air, land and/or water borne toy vehicles. For illustrations purposes only, a lighter-than-air toy blimp is used as an example to describe the teachings of this invention. The blimp includes conventional radio frequency remote control means known to the art for controlling vertical and horizontal flight patterns. A gondola is attached to the underside of the toy blimp which secures three reversible electric motors each having a propeller attached to its output shaft. Two of these motors are placed at each side of the gondola on a horizontal plane and are used to provide forward and reverse thrust. Also, steering is provided by placing one motor in reverse and the other in forward, or alternatively, turning off one motor while the other motor continues to run. The third motor is placed in the vertical plane under the gondola so that downward thrust of the motor pushes the blimp up or upward thrust pulls the blimp down.

One unique aspect of this invention is the addition of innovative remote control means for firing infrared weapons to enhance the amusement capability of prior-art toy blimps beyond a simple remote controlled flight or free flight. These infrared digital signals contain a series of ones and zeros representing a specific binary code defining (a) the type of weapon fired, such as a machine gun, high caliber cannon or an explosive missile and (b) the ID of the blimp firing the weapon. Each blimp has at least one infrared transmitter and at least one infrared receiver. The transmitter is used by the attacking blimp to shoot infrared signals and the receiver is used by the blimp under attack to detect and decode those infrared signals striking the blimp. The attacking pilot must first arm the weapon of choice by selecting between machine gun, cannon or explosive missile in the remote control unit. Then when the attacking blimp is properly aimed at opponent's blimp or wall target, the user presses the trigger button in the remote control unit to shot the armed weapon. These different weapons operate as follows.

Machine gun: Inflicts minor damage to the opponent's blimp. A high number of hits are required to shot down an opponent. A high quantity of ammunition is provided during arming prior to a "dog fight." However, since this is a rapid firing weapon, the trigger must be used judiciously to avoid prematurely running out of ammunition.

Cannon: Inflicts heavy damage to the stricken blimp. A lower number of hits are required to shot down the opponent's blimp. A low quantity of cannon rounds are available, therefore good aim is important.

Explosive Missiles: A single hit causes the immediate shot down of the opponent's blimp. Each blimp is loaded with only three missiles. As a defensive measure, the pilot of the blimp under attack may temporarily activate a "radar shield" in order to become invisible to the incoming missile. However, the "radar shield" is only active for a short time after which a "wait time" must be observed prior to reactivation. This may allow the attacking missile to slip through and hit the opponent's blimp if the missile is fired within the inactive window of the "radar shield". On the other hand, if a missile is fired when the "radar shield" is active, the attacking missile will miss the target and the attacker would have wasted one out of the three missiles available. The "radar shield" does not offer protection against machine gun or cannon shots.

Reloading: After all ammunition are fired, full reloading of all weapons systems may be accomplished by landing the blimp at the "docking station." Proper landing is confirmed by alignment between the electrical contacts at the bottom of the gondola and the corresponding contacts at the docking station. Once proper landing is confirmed, rearming commences and a preset waiting time must be observed for full reaming to take place. This may allow your opponent to shoot your blimp while it is rearming and/or refueling. If the full rearming time is not observed, partial rearming will occur and the next dog fight will be happen with a shortage of ammunition. When a blimp is finally shot down, the stricken blimp is forced into a "simulated crash maneuver" such as a fast descent. Additionally, a red lamp at the blimp will flash continuously to indicate a shot down situation.

In another aspect of this invention, one or more blimps can be used to simultaneously attack a wall target. The wall target decodes the binary code identifying the attacking blimp and the weapon type reaching the wall target, then it updates the score displayed for the appropriate blimp. One point is scored for each machine gun hit, five points for each cannon hit and twenty points for each missile hit.

In an additional aspect of this invention, each blimp is initially provided with a limited amount of time (fuel) used to power the blimp's motors. The blimp's microprocessor keeps track of the amount of time each motor is used. When the total allocated time is consumed, a yellow lamp under the gondola begins to flash continuously, indicating to its pilot that the blimp only has one more minute of motor power before it runs out of fuel. Then the blimp's pilot must land the blimp his/her "docking station" to refuel and rearm the blimp before it runs out of fuel. However, the opponent can destroy your docking station by shooting infrared weapons to it. Upon the number of hits reaching a preset number, a solenoid in the docking station is energized, causing the landing platform to collapse, thus preventing it's used for refueling or rearming.

In a final aspect of this invention, the angle of the infrared beam transmitted used to simulate a weapon firing, can be adjusted by means of a tube having a reflective inner surface which is attached in front of the infrared transmitting diode. Tubes of different lengths can used to obtain different beam angles.

The toy vehicle that is the subject of the invention can also be referred to as a "player toy vehicle" to distinguish it from the opponents toy vehicle.

DESCRIPTION OF THE PREFERRED EMBODIMENT

Figure 1:
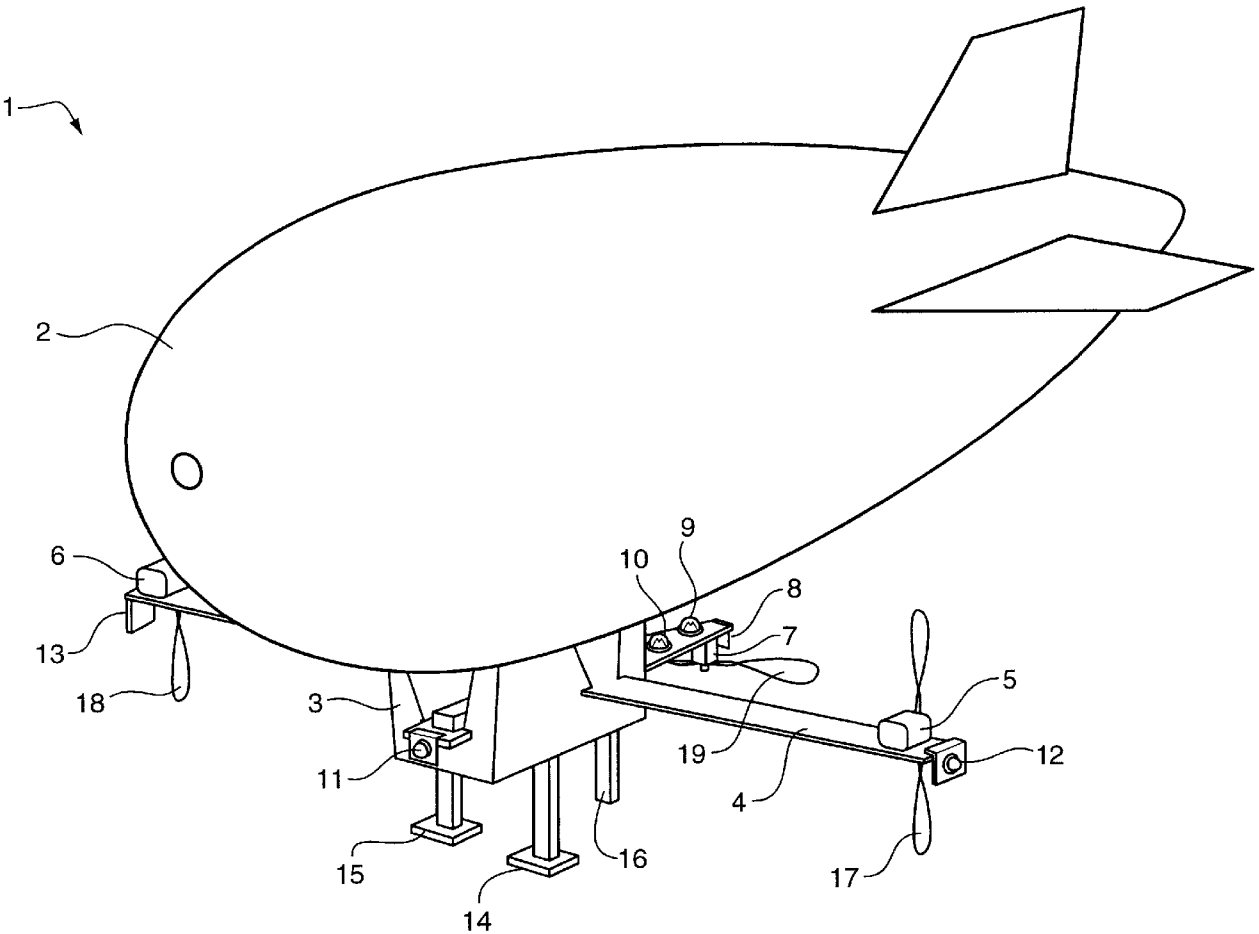
FIG. 1 is a perspective view of the remotely-controlled toy blimp 1 showing the blimp's gas filled body 2, the gondola 3, and the printed wired circuit board/chassis 4 integrating all three flight control motors 5, 6 and 7. Also shown are the "low fuel" lamp 9, the "hit lamp" 10 used to indicate a successful strike by the opponent, the infrared transmitter 11 used to shoot infrared weapons at (a) the opponent's blimp, (b) a wall target or (c) the opponent's docking station. Infrared detectors 12 and 13 which are employed to detect a direct hit by the opponent's infrared weapon are shown. Electrical contacts 14 and 15 which are used to confirm an on-target landing at the docking station and initiates rearming and refueling are shown. Also shown is the propeller 17 which is rotatably attached to the shaft of the motor 5, the propeller 18 which is rotatably attached the shaft of motor 6 and the propeller 19 which is rotatably attached to the shaft of the motor 7 with the three reversible electric motors being used to control the direction and altitude of the blimp's flight.

Referring now to the drawings in greater detail, a toy blimp 1 filled with lighter-than-air gas is illustrated in FIG. 1, having an inflatable body 2 that is shaped like a blimp and a gondola 3 attached under the body 2. This gondola 3 accommodates the printed wired circuit board/chassis 4 which integrates all the circuitry required to decode and execute the flight and weapon commands (transmitted by RF transmitter 25 of FIG. 3), but also provides the structural support for the three flight motors 5, 6 and 7. The horizontal flight motors 5 and 6 are located at the end of supporting beams which are sideways extensions of the printed wired board/chassis 4. The vertical flight motor 7 is located at the bottom rearward extension of the printed wired circuit board/chassis 4.

When motors 5 and 6 are driven to provide rearward air flow, the blimp 1 is displaced forward. When motors 5 and 6 are driven to provide forward air flow, the blimp 1 is displaced backward. When the motor 5 is driven to provide rearward air flow and motor 6 is driven to provide forward air flow, the blimp 1 will turn to the right. When the motor 5 is driven to provide forward air flow and motor 6 is driven to provide backward air flow, the blimp 1 will turn to the left. When motor 7 is driven to provide downward air flow, the blimp 1 will ascend. When motor 7 is driven to provide upward air flow, the blimp 1 will descend. The printer wired circuit board/chassis 4 incorporates infrared detectors 12 and 13 which are used to detect a hit from the opponent's infrared weapon. Also, the printed wired circuit board/chassis 4 incorporates the infrared transmitter diode 11 which is used as a weapon to fire infrared light beams at the opponent's blimp. Additionally, the printed wired circuit board/chassis 4 incorporates a pair of electrical contacts 14 and 15 pointing downward which are used to confirm on-target landings at the "docking" station for rearming and refueling purposes. Lastly, the printed wired circuit board/chassis 4 incorporates lamp 9 to indicate a "low fuel" condition and lamp 10 to indicate a "hit" by the opponent's infrared weapon.

Figure 2:
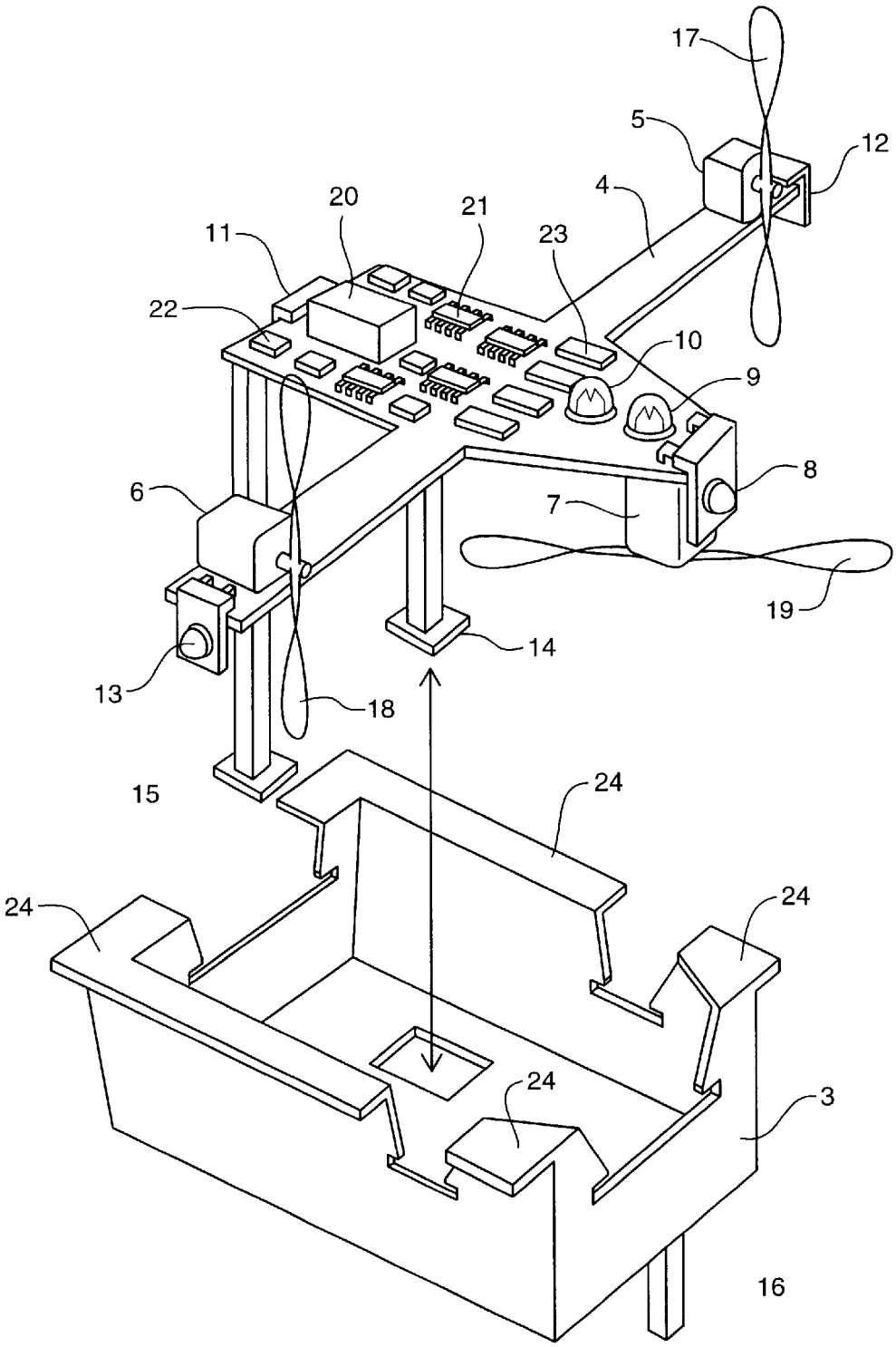
FIG. 2 is an exploded perspective view of the circuit board and gondola illustrating the assembly of the printed circuit board/chassis 4 and the gondola 3.
Figure 2A:
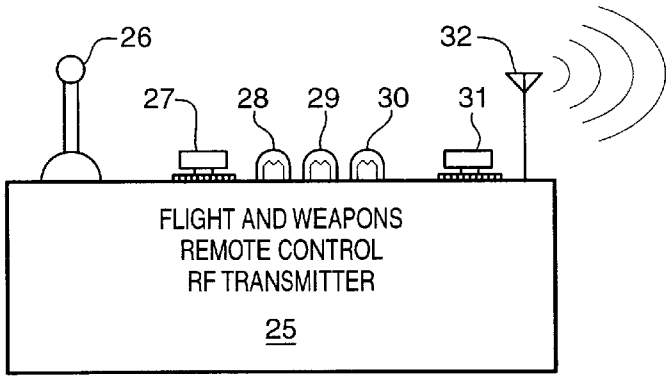
FIG. 2A is a block view of the Flight And Weapons Remote Control RF Transmitter.
Figure 2B:
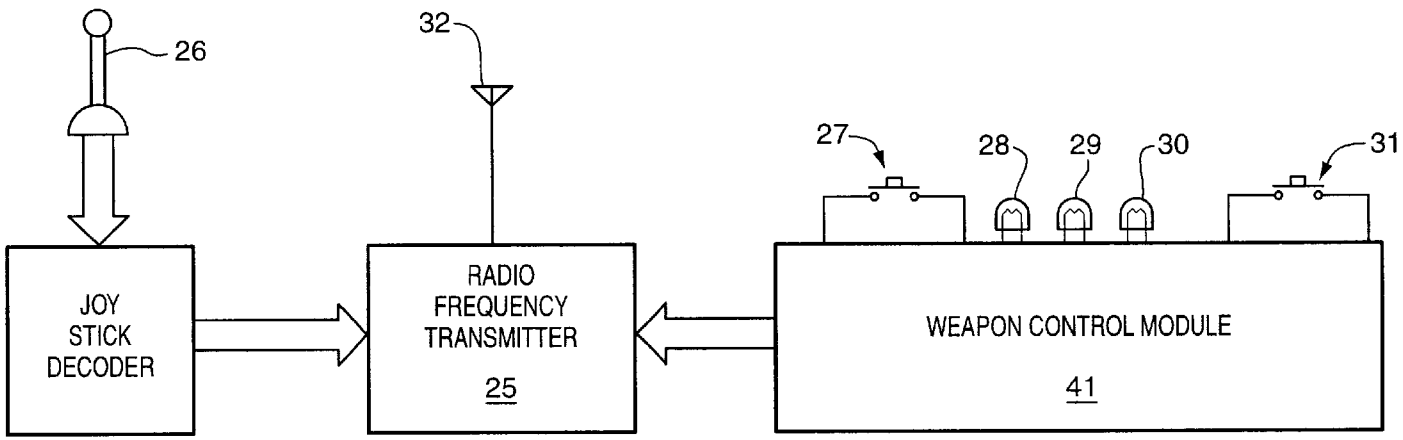
FIG. 2B is a plan view of the Joy Stick Decoder, the Radio Frequency Transmitter and the Weapon Control Module.

Referring to FIG. 2, this is an exploded view illustrating the assembly of the printed wired circuit board/chassis 4 into gondola 3. The gondola 3 is attached under the body 1 of the toy blimp by means of hook and loop strips 24 sold under the trademark VELCRO.

An additional aspect of this invention, is that the printed wired circuit board/chassis 4 integrates two normally unrelated functions: (a) it is used to interconnect all the electrical components, such as battery 20, resistors 22, capacitors 23, integrated circuits 21, etc., and (b) also serves as the structural beam to mechanically support all three flight motors 5, 6 and 7. This innovative application of a printed circuit board in a toy blimp significantly reduces the number of parts required to assemble a toy blimp, substantially reduces the assembly time and costs by eliminating many independent wires or harnesses and structural members while at the same time improving reliability and functionality.

Figure 3:
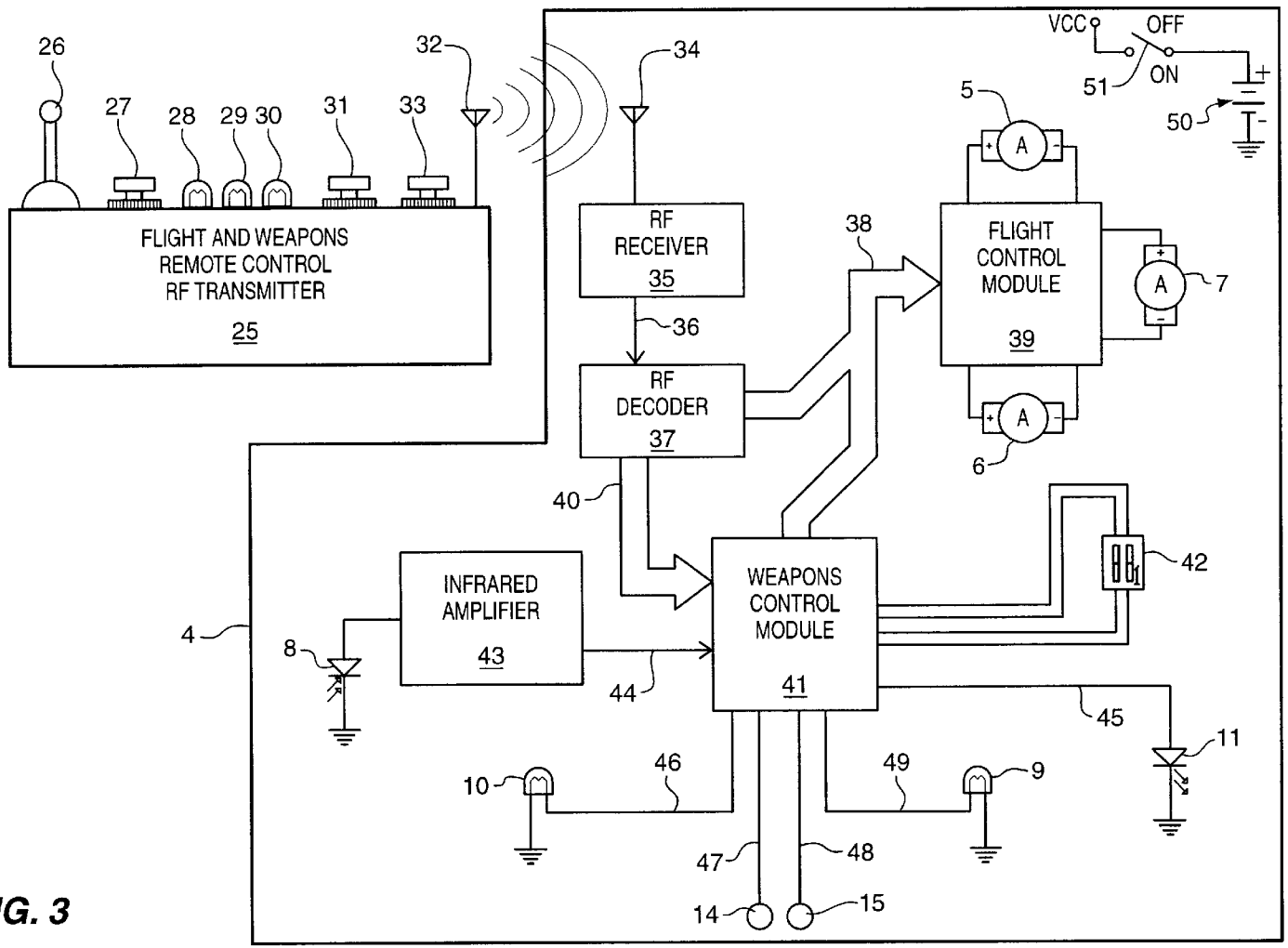
FIG. 3 is the electrical block diagram for the printed circuit board 4 of FIG. 2. Also shown is the remote control RF transmitter 25 which the pilot employs to transmit flight and weapons commands to blimp 1. Further shown are the interconnections of all the electrical components, which additionally and unconventionally also serves as a structural beam to support all three flight motors, greatly reducing (a) the number of parts required, (b) the assembly time and (c) the cost of the toy blimp.

Referring to FIG. 3, it illustrates the electrical block circuit diagram for the printed wired circuit board/chassis 4 of FIG. 2. Briefly directing ones attention to the remote control RF transmitter 25, this unit is used by the pilot to transmit flight and weapons commands to the blimp 1 of FIG. 1. The pilot uses joy stick 26 to change the direction and/or elevation of the blimp 1. Also, the pilot presses push button 27 to select the weapon to be fired. A machine gun is selected when lamp 28 is lit. A cannon is selected when lamp 29 is lit. An explosive missile is selected when lamp 30 is lit. The pilot presses the trigger button 31 to fire the selected weapon. If the pilot suspects that the opponent is about to shoot a missile at his/her blimp, the pilot may activate a temporary "radar shield" on his blimp by pressing the shield button 33. This "radar shield" makes his/her blimp invisible to the opponent's missile, causing it to miss his/her blimp. The "radar shield" is accomplished by temporarily suspending decoding of incoming missiles at the weapons control module 41. The flight and weapons commands are transmitted from antenna 32 to antenna 34 where they are transformed into a series of binary ones and zeros by RF Receiver 35 and supplied via wire 36 to RF decoder 37 where they are assembled into distinctive binary codes representing flight and weapons commands. The flight commands are supplied via buss 38 to the flight control module 39 which interprets which motors, 5, 6 and /or 7 are to be energized and in what direction. Weapon commands are supplied via buss 40 to the infrared weapons control module 41 which interprets what infrared weapon is to be fired. Then weapons control module 41 supplies, via wire 45, a burst of current pulses representing the weapon fired. These current pulses are supplied to infrared transmitter 11, producing a series of infrared light flashes. The interval between flashes is modulated to denote a one or a zero. A unique code identifies the weapon type and is followed by a series of pulses each representing a single machine gun bullet, cannon shell or a missile. If the weapon is the machine gun, bullets continuously will be fired for as long as the pilot keeps the trigger button 31 depressed. If the weapon is a cannon, a single shell will be fired each time the trigger button 31 is pressed, but the trigger 31 must be first released and then depressed again to fire another shell. If the weapon is an explosive missile, one missile will be fired each time the trigger 31 is depressed.

Now directing ones attention to the opponent's blimp, the infrared flashes fired by the attacking blimp are converted back into current pulses by infrared detector 8. These current pulses are decoded by infrared amplifier 43 into a series of binary ones and zeros. These binary signals are then supplied via wire 44 to the weapons control module 41 for weapon identification and to count the number of successful hits. If the weapon fired by the attacking blimp was a machine gun burst, module 41 will count and record how many hits (flashes) it detected. If the existing count reaches or exceeds one hundred hits, the infrared weapons control module 41 will force the blimp into a "shot down maneuver" which is a steep and rapid descent. If the weapon fired by the attacking blimp was a cannon burst, the weapons control module 41 will count and record how many hits (flashes) it detected. If the current count reaches or exceeds fifteen hits, the infrared weapons control module 41 will force the blimp into a "shot down maneuver". If the weapon fired by the attacking blimp was a missile, the infrared weapons control module 41 will immediately force the blimp into a "shot down maneuver". Each time a hit is sensed by the infrared detector amplifier 43, the weapons control module 41 will cause, via wire 45, lamp 10 to light for a short duration to indicate a successful hit. During a "shot down maneuver" infrared weapons control module 41 will cause, via wire 46, lamp 10 to flash continuously for a preset time to indicate that a lethal shot down has occurred.

Figure 4A:
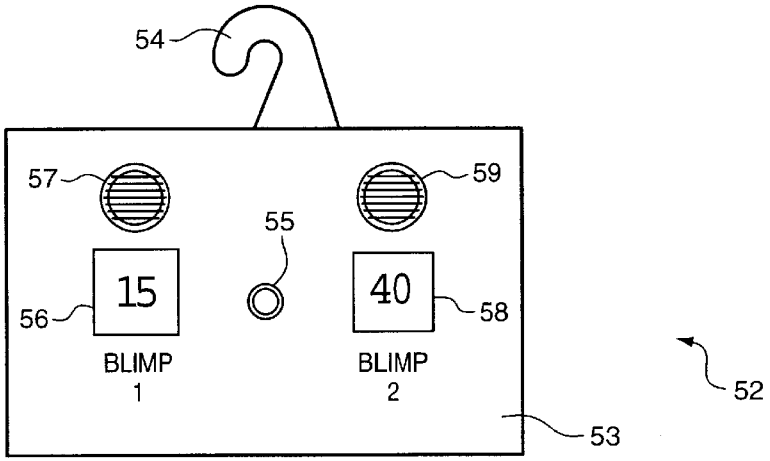
FIG. 4A illustrates a wall mounted target 52 used for target practicing by one or two toy blimps.

Referring to FIG. 4A, a wall mounted practice target 52 is shown. The unit is contained in an enclosure 53. The unit may be hung from a nail in the wall by means of hook 54. Wall target 52 incorporates an infrared detector 55 which detects a direct hit by an infrared weapon. One or more blimps can shoot infrared weapons at the target. Each infrared hit is decoded to identify the attacking blimp and the weapon fired. Then the score is updated at the corresponding display 56 or 57 in the wall target 52. Each missile hit will add one hundred points to the corresponding score. Each cannon hit will add twenty five points to the corresponding score. Each machine gun hit will add five points to the corresponding score. Additionally, speakers 57 or 59 will emit a distinctive tone identifying the scoring blimp.

Figure 4B:
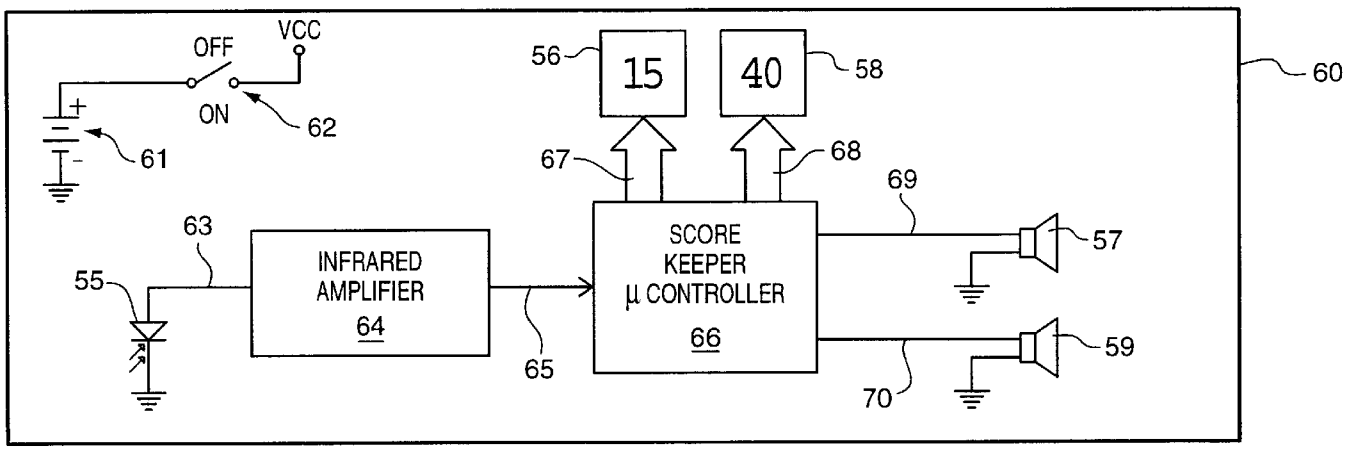
FIG. 4B illustrates the electrical block diagram employed in the wall mounted target 52.

Referring to FIG. 4B, it illustrates the electrical block diagram employed by the wall target 52. When a direct hit by an infrared weapon strikes infrared detector 55, the received infrared flashes are amplified and transformed by infrared amplifier 64 into a series of current pulses representing binary codes identifying both, the attaching blimp and the type of weapon fired. This information is passed, via wire 65, to the score keeper $\mu$P 66 which decodes the information, updates the corresponding display 56 or 58 and sounds the appropriate speaker to identify the scoring blimp.

Figure 5A:
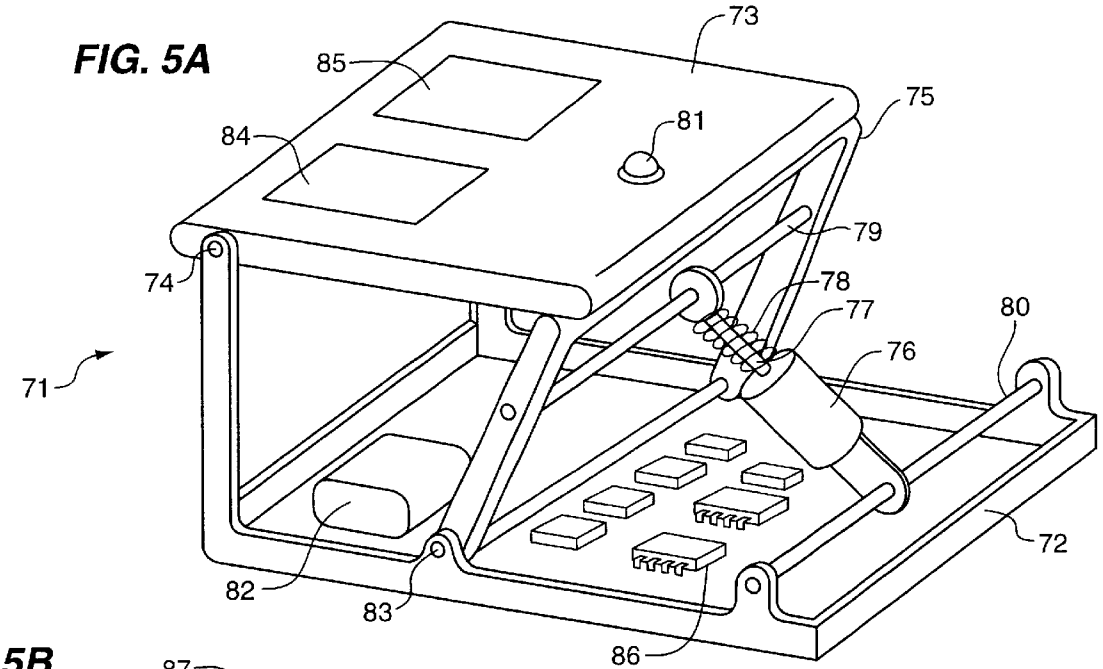
FIG. 5A is a perspective view of the docking station 71 used for rearming and refueling the toy blimp.

Referring to FIG. 5A, this is a perspective view of the docking station 71 used for rearming and refueling the toy blimp 1. The docking station 71 incorporates an infrared detector 81 which senses a direct infrared hit by the opponent's infrared weapon. The docking station 71 incorporates a solenoid 76 which is mechanically attached between pins 79 and 80. Pin 79 is attached to the release lever 75 and pin 80 is attached to the base 72. Platform 73 pivots at shaft 74 at one end while the other end normally rest on top of the release lever 75. The bottom of release lever 75 is free to pivot at shaft 83 which connects the release lever 75 to the base 72. Battery 82 provides the electrical power to energize solenoid 76. Additionally, the docking station 71 incorporates the score keeper $\mu$P 86 which keeps a running score of the successful infrared hits made by the opponent's weapon and, as a secondary function, also confirms a proper landing by a blimp when electrical contacts 84 and 85 of docking station 71 mate with the electrical contacts 14 and 15 of blimp 1 in FIG. 1. A secondary function of mating contacts 84 and 14 is to send a partial or full rearming signal to the blimp 1. Similarly, a secondary function of mating contacts 85 and 15 is to send a partial or full refuel to the blimp 1. The low fuel lamp 9 will turn off only upon reaching a full fuel condition. Upon the running score reaching the "destruction threshold", score keeper $\mu$P 81 will briefly energize solenoid 76, pulling solenoid plunger 77 into its' cylinder and compressing spring 78. As the solenoid plunger 77 is drawn inside solenoid 76, it will pull shaft 79 and release lever 75 towards the solenoid 76. When the top of release lever 75 clears the end of the landing platform 73, this end of the landing platform 73 will collapse under its' own weight and jam in the down position between pin 79 and the upper bar of the release lever 75. In this manner, the docking station 71 is rendered out of order for future rearming or refueling until the platform 73 is manually reposition on top of the release lever 75. This requires that each pilot to not only protects his/her blimp but also his/her docking station as well.

Figure 5B:
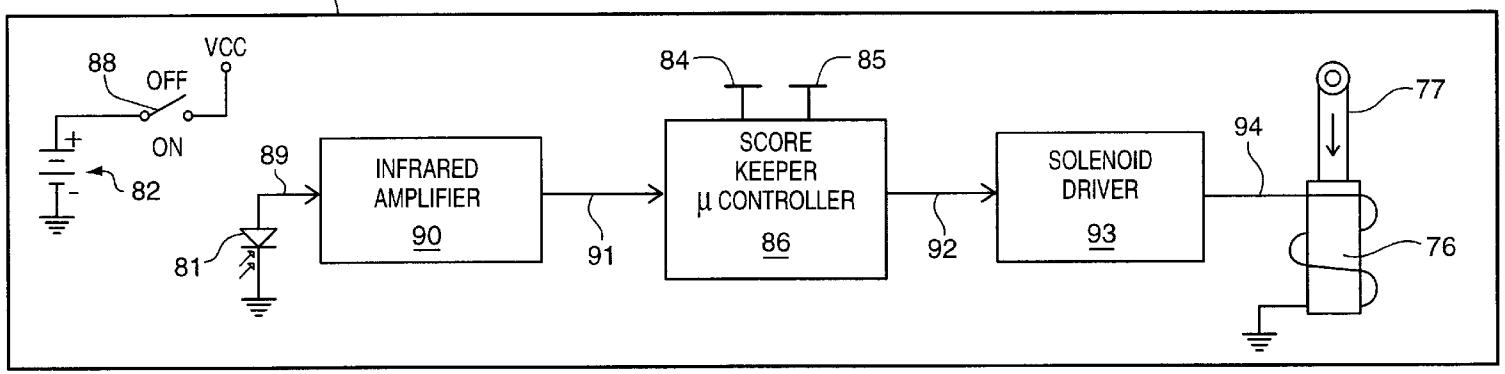
FIG. 5B illustrates the electrical block diagram employed in the docking station 71.

Referring to FIG. 5B, it illustrates the schematic block diagram used in the printed circuit board 87 for the docking station 71 of FIG. 5A. When the opponent's infrared light beam (weapon) hits infrared detector 81, these signals supplied, via wire 89 to infrared amplifier 89 where they are amplified and shaped into current pulses representing a series of binary ones and zeros and supplied, via wire 91 to score keeper $\mu$P 86 which decodes and identifies the type of weapon fired and the number of successful hits made. Upon the running score reaching the "destruction threshold", solenoid 76 is briefly energized which pulls, now in FIG. 5A, the release lever 75 away from under the landing platform 73. This allows the landing platform 73 to collapse under its' own weight, thus temporarily rendering the docking station out of order for future rearming or refueling until manually reset.

It is understood that the same principles explained here can be applied to other types of remotely controlled toys, including model airplanes, boats and land vehicles.

Figure 6:
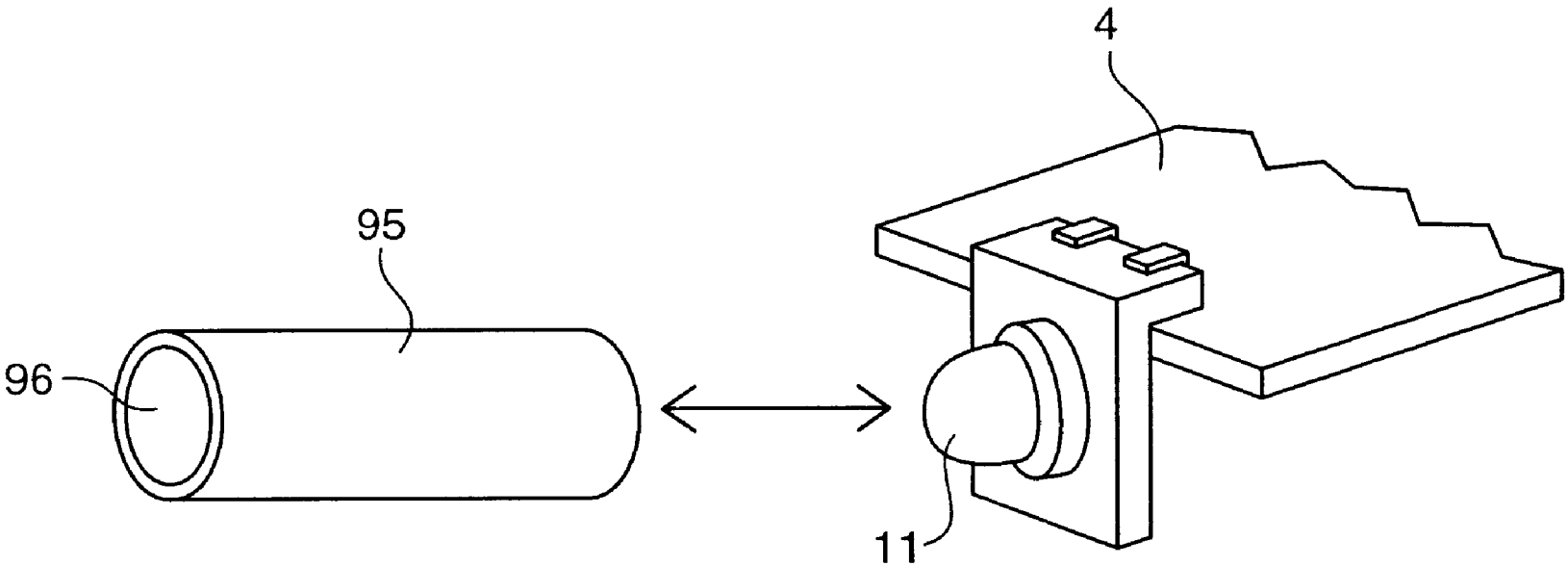
FIG. 6 illustrates the infrared beam angle reducer tube 95 employed to concentrate the infrared light emitted by infrared transmitter 11 into a narrow angle beam in order to increase the level of difficulty for hitting the target.

Referring to FIG. 6, this is a perspective view of the infrared beam angle reducer tube 95 used to concentrate the infrared light into a narrow beam in order to increase the level of difficulty required for hitting the target. The angle reducer tube 95 has a reflective inner surface 96, such as a Millar, so that all of the infrared light emitted by infrared transmitter 11 is focused into a narrow beam. The actual diameter of the beam can be adjusted by changing the length of the tube 95. A longer tube will produce a narrower beam and a shorter tube will produce a wider beam.

From the foregoing description, it will be apparent that the toy blimp of the present invention includes the above described method of construction and use, circuitry, software, hardware, and mechanical mechanisms for providing: (a) a defensive shield, (b) infrared weapons of different types, (c) distinctive operation for each type of weapon, (d) adjusting the beam angle of the infrared transmitter weapon for varying the level of difficulty required for hitting the target, (e) structural supports for the flight motors incorporated into the printed circuit board, (f) a practice target with different audible tones to identify the hits made by each blimp and two displays to show the score for each attacking blimp, (g) software induced "shot down" maneuver upon reaching a specific number of hits, (h) a lamp to indicated a "shot" down condition, (i) a lamp to indicate a "low fuel" situation, and (j) a docking station for refueling and rearming. Also, it will be apparent that the present invention has a number of advantages, some of which are described above and others which are inherent in the invention. Further, it will be understood that modifications can be made to the invention without departing from the teachings of the invention, and that the teachings of the present invention can also be applied to other toy vehicles, such as land vehicles, toy boats and fast model airplanes.

Accordingly, the scope of the present invention is only to be limited as necessitated by the accompanying claims.

We claim:

1. A remote-controlled air, land or water borne player toy vehicle comprising: a remote control transmitter console used by a pilot of the player toy vehicle to:

(a) control the speed, direction, or altitude of the player toy vehicle, (b) select among several weapons including a machine gun, a cannon and a missile, each simulated by a unique infrared code, and (c) shoot a selected weapon;

an infrared light transmitting means for shooting a series of infrared light pulses at an opponent's toy vehicle;

encoding means for modulating said infrared light pulses to (a) specify the type of weapon fired and (b) identifying the toy vehicle firing said infrared pulses;

an infrared light detecting and amplifying means for sensing said infrared light pulses fired by an opponent's weapon;

decoding means for (a) identifying the type of weapon fired by the opponent's toy vehicle and (b) identifying the opponent's toy vehicle doing the shooting;

score keeping means for up-dating and storing the number of successful hits made by the opponent's toy vehicle.

2. A player toy vehicle according to claim 1 in which said player toy vehicle also comprises:

comparing means for comparing an up-dated score against a preset threshold value;

response means which, upon a player reaching said preset threshold value for affecting the navigation ability of said player toy vehicle, being able to simulate a vehicle out of control.

3. A player toy vehicle according to claim 1 in which said player toy vehicle also comprises: blocking means for temporarily suspending the detection of specific weapons in order to simulate a shield against such weapons.

4. A player toy vehicle according to claim 1 in which said player toy vehicle also comprises: beam reducing means for decreasing the diameter of the transmitted infrared beam in order to increase the level of difficulty required to successfully hit a target.

5. A player toy vehicle according to claim 1 in which said player toy vehicle also comprises: lamp activating means for indicating when a hit by the opponent's infrared weapon has been detected.

6. A player toy vehicle according to claim 1 in which said player toy vehicle also comprises: lamp activating means for indicating when a low fuel condition has been detected.

7. A player toy vehicle according to claim 1, including a wall target for shooting practice purposes, said wall target comprising:

infrared light detecting and amplifying means for sensing said infrared light pulses fired by the player toy vehicles;

decoding means for (a) identifying the type of weapon fired by said player toy vehicle and (b) identifying the player toy vehicle doing the shooting;

score keeping means for up-dating and storing the number of successful hits made by player toy vehicle, said score keeping means being capable of handling the scores for more than one player; and, audible tone generating means for announcing each successful hit, said tone generating means being capable of producing more than one unique tone to identify more than one player.

8. A player toy vehicle according to claim 1 in which said player toy vehicle is a lighter-than-air toy blimp, including a docking station and a landing platform for landing said toy blimp for refueling and rearming purposes, said docking station comprising;

timing means for counting the seconds or minutes that said toy blimp remains parked at said landing platform;

responsive means responsive to said timing means for activating partial rearming if said toy blimp remains parked for a first preset time;

responsive means responsive to said timing means for activating full rearming if said toy blimp remains parked for a second preset time longer than said first;

responsive means responsive to said timing means for activating partial refueling if said toy blimp remains parked for a first preset time; and, responsive means responsive to said timing means for activating full refueling if said toy blimp remains parked for a second preset time longer than the first.

9. A player toy vehicle according to claim 8 also comprising:

an infrared light detecting and amplifying means for sensing said infrared light pulses fired by said opponent's weapon;

a decoding means for identifying the type of weapon fired the opponent's toy vehicle;

a score keeping means for up-dating and storing the number of successful hits made by the opponent's toy vehicle blimp;

a comparison means for comparing said up-dated score against a preset threshold value;

responsive means responsive to said score reaching said preset threshold value for disabling said docking station to prevent refueling and/or reaming.

10. The player toy vehicle 1 wherein each weapon imparts a different level of damage to an opponent's toy vehicle so that a different number of hits from each weapon is required for forcing down an opposing toy vehicle, namely a first number for machine gun hits, a second number for canon hits or one or more hits for missile hits.

11. The player vehicle of claim 10, wherein one hundred (100) machine gun hits are needed to force down an opposing vehicle.

12. The player vehicle of claim 10, wherein fifteen (15) cannon hits are needed to force down an opposing vehicle.

13. The player vehicle of claim 10 wherein 1 (1) missile hits are needed to force down an opposing vehicle.

14. A remote-controlled air, land or water borne player toy vehicle comprising:

a body;

a printed circuit board mounted in or to said body;

a receiver connected to said printed circuit board for receiving commands; hardware on said printed circuit board including control means for manipulating said player toy vehicle in response to commands received by said receiver;

at least one infrared emitting simulated weapon mounted on said player toy vehicle for shooting a series of infrared light pulses at an opponent's toy vehicle;

encoding means for modulating said infrared light pulses (a) to specify the type of weapon fired selected from one of a machine gun, cannon or explosive missile and (b) identifying the toy vehicle firing said infrared pulses; and, motor drive means mounted on or to said player toy vehicle for moving or propelling said toy vehicle in response to control signals from said control means.

15. The player toy vehicle of claim 14 combined with a remote control transmitter console for use by a pilot of the player toy vehicle to control the speed, direction, or altitude of the player toy vehicle.

16. The player toy vehicle of claim 15, wherein said remote control transmitter console includes a timer circuit for simulating operation time and fuel consumption and a lamp for indicating a "low fuel" situation.

17. The player toy vehicle of claim 16, wherein said remote control transmitter console has a lamp to indicated a "shot" down condition.

18. The player toy vehicle of claim 14, wherein said simulated weapons are each simulated by a unique infrared code and each simulated weapon imparting a different level of damage to an opponent's toy vehicle.

19. The player toy vehicle of claim 14, including an infrared light detecting and amplifying means for sensing said infrared light pulses fired by an opponent's weapon; and decoding means for (a) identifying the type of weapon fired by the opponent's toy vehicle and (b) identifying the toy vehicle doing the shooting.

20. The player toy vehicle of claim 14, comprising a simulated defensive shield which disables said light detecting and amplifying means.

21. The player toy vehicle of claim 19 including means responsive to said light detecting and amplifying means for simulating a "shot down" maneuver upon sensing a specific number of infrared hits.

22. The player toy vehicle of claim 14 combined with a remote control transmitter console for use by a pilot of the player toy vehicle to direct command signals to the player toy vehicle: (a) to select among several weapons each simulated by a unique infrared code, and (b) shoot a selected weapon at an opponents toy vehicle.

23. The player toy vehicle of claim 22 including an infrared light detecting and amplifying means for sensing said infrared light pulses fired by an opponent's weapon; and decoding means for (a) identifying the type of weapon fired by the opponent's toy vehicle and (b) identifying the toy vehicle doing the shooting.

24. The player toy vehicle of claim 23 including score keeping means for up-dating and storing the number of successful hits made by the opponent's toy vehicle.

25. The player toy vehicle of claim 24 including a transmitter for transmitting signals representing data stored in said score keeping means to said remote control transmitter console; polling means in said transmitter console for polling said score keeping means; and, display means for displaying the hits on the opponents toy vehicle.

26. The player toy vehicle of claim of claim 14 including means for adjusting a beam angle of an infrared transmitter simulating a weapon for varying the level of difficulty required for hitting a target.

27. The player toy vehicle of claim 14 combined with a practice target having means for producing different audible tones to identify respective hits made by different toy vehicles and having two displays to show the score for each attacking toy vehicle.

28. The player toy vehicle of claim 14 combined with a docking station for simulated refueling of said player toy vehicle.

29. The player toy vehicle of claim 14 combined with a docking station for simulated rearming of the simulated weapons.

30. The player toy vehicle of claim 14, wherein said motor drive means are mounted on said printed circuit board which provides a structural support for the motor drive means mounted on the printed circuit board.

31. The player toy vehicle of claim 14 being a blimp and said motor drive means include flight propellers.

32. The player toy vehicle of claim 14, wherein each weapon imparts a different level of damage to an opponent's toy vehicle so that a different number of hits from each weapon is required for forcing down an opposing toy vehicle, namely a first number for machine gun hits, a second number for canon hits or one or more hits for missile hits.

* * * * *